United States Patent [19]

Walters

[11] 4,073,477

[45] Feb. 14, 1978

[54] RAILING WITH INTERFITTING RECTANGULAR AND CURVED CROSS SECTION MEMBERS

[76] Inventor: Donald H. Walters, 493 Stanford Drive, Arcadia, Calif. 91006

[21] Appl. No.: 722,739

[22] Filed: Sept. 13, 1976

[51] Int. Cl.[2] ..... B21F 27/00

[52] U.S. Cl. ..... 256/22; 256/69

[58] Field of Search ..... 256/59, 65, 21, 22, 256/24, 68, 69, 72

[56] References Cited

U.S. PATENT DOCUMENTS

| | | | |
|---|---|---|---|
| 3,313,527 | 4/1967 | Eriksson | 256/65 |
| 3,482,819 | 12/1969 | Leurent | 256/59 |
| 3,485,006 | 12/1969 | DeRozario | 256/65 X |
| 3,491,984 | 1/1970 | Nyberg | 256/21 |
| 3,498,589 | 3/1970 | Murdock | 256/21 X |
| 3,596,880 | 8/1971 | Greenberg | 256/59 X |
| 3,918,686 | 11/1975 | Knott | 256/59 |
| 3,955,799 | 5/1976 | Lauzier | 256/59 X |

FOREIGN PATENT DOCUMENTS

| | | | |
|---|---|---|---|
| 1,475,039 | 2/1967 | France | 256/65 |

*Primary Examiner*—Andrew V. Kundrat

*Attorney, Agent, or Firm*—William W. Haefliger

[57] ABSTRACT

A railing assembly comprises:

a. an upright post having rectangular cross section in horizontal planes, b. an elongated upper rail including an upper section having an upwardly convex generally semicircular cross section in a plane normal to the direction of elongation, said upper section opening downwardly and extending directly over the open top of said post, the post supporting the upper section, c. primary anchor means extending upwardly into the rail upper section and downwardly into the top of the post to anchor the rail to the post, and d. an elongated bottom closure section attached to the rail upper section to close said downward opening, said closure section extending endwise proximate the side of the post.

12 Claims, 10 Drawing Figures

RAILING WITH INTERFITTING RECTANGULAR AND CURVED CROSS SECTION MEMBERS

BACKGROUND OF THE INVENTION

This invention relates generally to railings, and more particularly concerns railings employing rectangular posts to support and connect to arcuate or circular cross-section rails, with provision for easy manual assembly of these elements at a job-site, or in a shop, using rigid connections between the rails and posts.

There is a continual need for attractive, sturdy railings of low-cost, economical construction and capable of rapid assembly at a job-site with no welding. In my co-pending application entitled "Railing Assembly and Method", filed Apr. 26, 1976, I have described one such railing wherein the hand rail has rectangular cross-section to interfit a rectangular cross-section post, and wherein a bottom rail also has rectangular cross-section. Certain interlock techniques were also described.

SUMMARY OF THE INVENTION

It is a major object of the invention to provide a railing construction which employs a non-rectangular cross-section hand rail which quickly assembles to a rectangular cross-section post or posts, a non-rectangular bottom rail also being usable. As will be seen, circular cross-section rails may be employed. Another object of the invention is to provide improved rail and post interlock connections.

Basically, the invention is embodied in a railing assembly comprising the following combination of elements:

a. an upright post having square or rectangular cross-section in horizontal planes, b. an elongated upper rail including an upper section having an upwardly convex generally semicircular cross-section in a plane normal to the direction of elongation, the upper section opening downwardly and extending directly over the open top of the post, the post supporting the upper section.

c. primary anchor means extending upwardly into the rail upper section and downwardly into the top of the post to anchor the rail to the post, and d. an elongated bottom closure section attached to the rail upper section to close said downward opening, the closure section extending endwise proximate the side of the post.

In this combination, the closure section may be semicircular in cross-section to form a generally circular continuation of the rail upper section, and it is clear that the assembly of the railing is made simple and rapid by virtue of the fact that the rail upper section is anchored to the post, and the closure section is attached to the upper section, whereby the closure section may appear to be directly anchored to the side of the post but is not, and the circular cross-section hand railing appears to be sturdily integrated to the rectangular cross-section post both at its top and at its sides.

Further, the hand rail upper and lower sections may have retention shoulders with detent locking interengagement concealed within the hollow interior of the rail; the primary anchor means may include upwardly projecting tines which interlock to endwise continuations of the retention shoulders or ledges in the upper section which also interlock with the lower section; and the primary anchor means may include a downwardly projecting ring or loop received into the post, there being an adjustable retainer to adjustably clamp and expand the loop for regulating the frictional retention of the anchor to post interior surfaces.

In addition, an elongated bottom rail of circular cross section may extend between the rectangular cross section posts; the bottom rail may include upper and lower sections having concealed detent interlock; and secondary anchor means may extend endwise into the bottom rail and the post, the secondary anchor means also incorporating expandable loops or rings as will be seen. Finally, pickets may be provided to have concealed detent interlock with the upper and lower rails, as will be seen.

These and other objects and advantages of the invention, as well as the details of illustrative embodiments, will be more fully understood from the following description and drawings, in which:

DRAWING DESCRIPTION

FIG. 1 is a perspective showing of a railing incorporating the invention;

FIG. 1*a* is a fragmentary side elevation of a post and upper rail joint;

DETAILED DESCRIPTION

Figure 1:
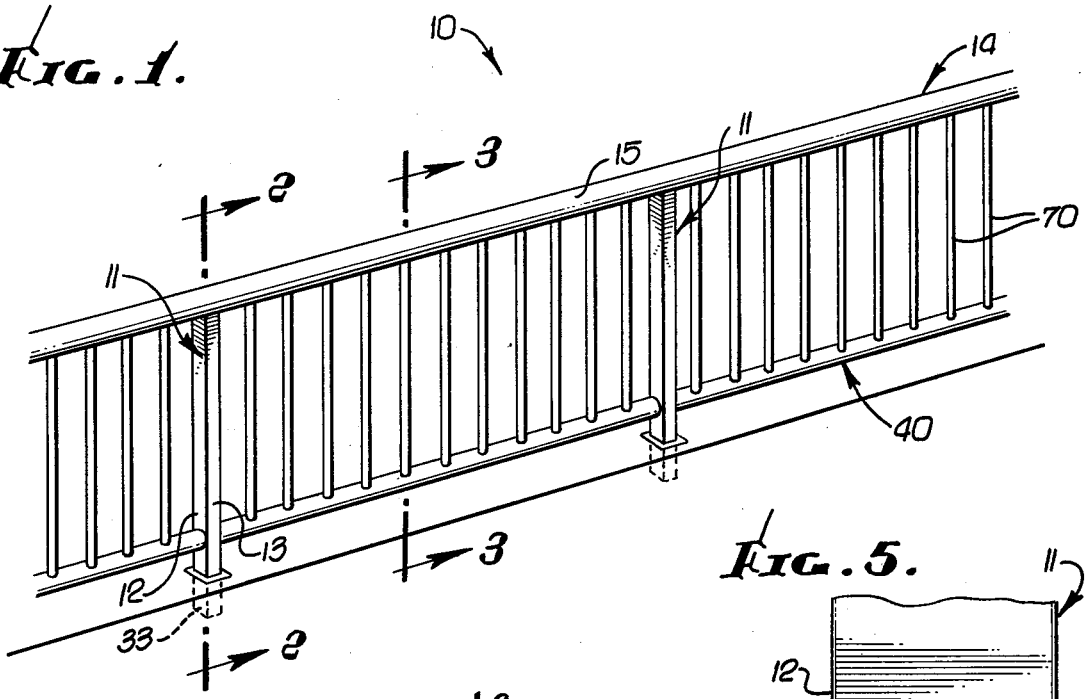
Figure 1A:
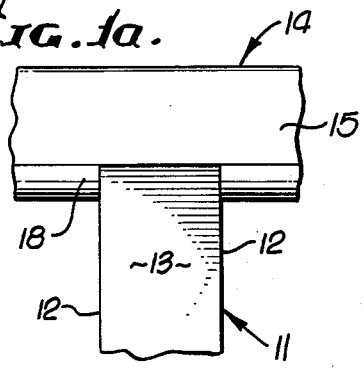

Referring first to FIGS. 1, 1*a*, 2 and 6, the railing assembly 10 includes upright posts 11 which are hollow and have rectangular cross-section in horizontal planes. For example, each post includes opposite side walls 12, and opposite side walls 13 normal to walls 12.

An elongated upper rail 14 is provided to quickly attach to the posts, the rail including an upper section 15 having an upwardly convex, generally semicircular cross-section in a plane normal to the direction of elongation. The upper section 15 opens downwardly at its under side, and along its length, and it also extends directly over the open top of the post and seats on the post at 16. Laterally projecting ledges 17 are laterally spaced apart and define the opening at the under side of the upper section. In addition, an elongation bottom closure section 18 is attached to the rail upper section 15 to close off the downward opening therein; also, the bottom closure section 18 extends endwise toward and proximate the side 12 of the post, appearing to abut same in FIG. 1*a*. Typically, two such bottom closure sections extend into proximity to the opposite sides 12 of the post 11. Further, it will be noted that the bottom closure sections are typically semi-circular in cross section (see FIG. 3) so as to form a circular continuation of the rail upper section 15, whereby the rail 14 appears tubular whereas the post is rectangular. The joinder of these elements appears smooth, monolithic and undetachable, in FIG. 1*a*; in point of fact, however, the bottom sections 18 are joined to the upper section 15 and not to the post, whereas the upper section is anchored to the post.

Figure 2:
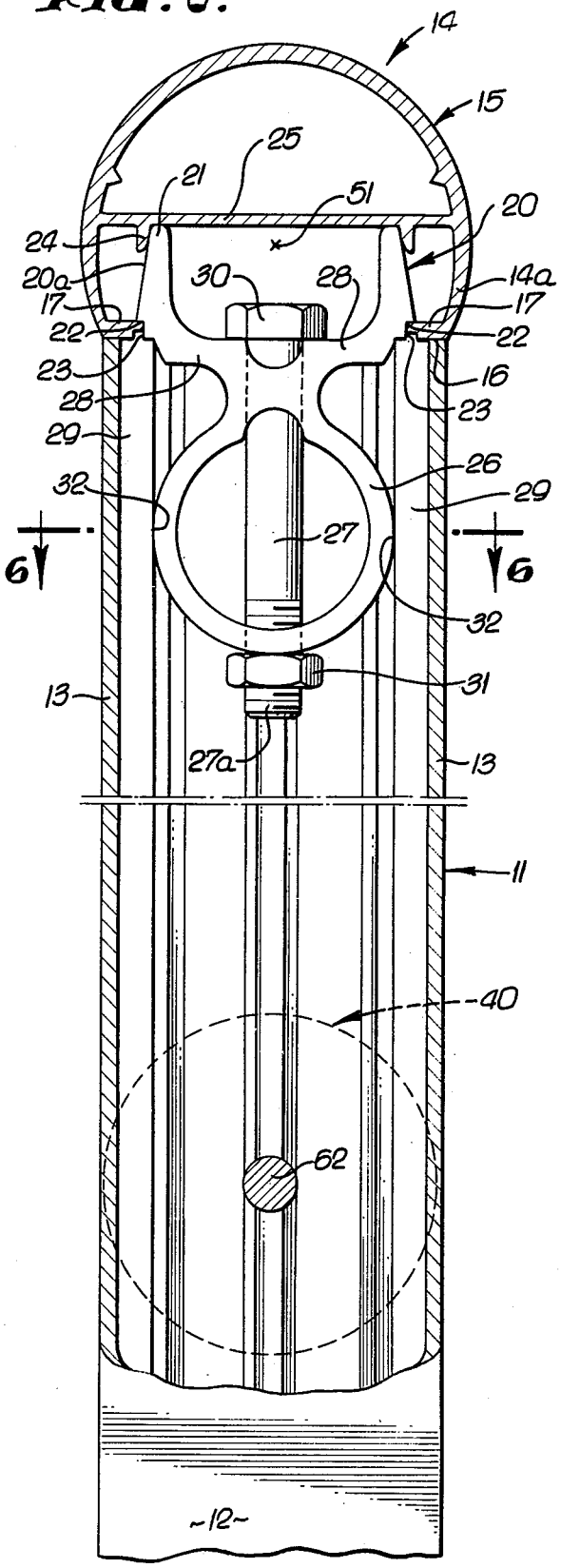
FIG. 2 is an enlarged vertical section on lines 2—2 of FIG. 1.

In this regard, and referring now to FIG. 2, primary anchor means is provided to extend upwardly into the rail upper section 14 and downwardly into the top of the post 11, to anchor the rail to the post. As shown, the primary anchor means may, with unusual advantage, include a pair of upwardly projecting camming tines 20 which are laterally spaced apart. Each tine 20 defines an upper terminal 21 and a lower step shoulder 22 formed by a side notch 23 to interfit the edge of a ledge 17. Note that the tines 20 taper upwardly, as defined by cam shoulders 20*a*, so that as the tines are pushed relatively upwardly into the section 15 they tend to yieldably spread the ledges and their supporting flanges 14*a* of the upper section, until the ledges snap into the notches 23, with detent interfit or interlock. Step shoulders 22 then block retraction of the tines from interfit position. The rail upper section also is shown as defining downwardly projecting tongues 24 carried by a cross-piece 25, the tongues having camming interengagement with the tine upper terminals 21 to center the tines in relation to the rail upper section 15, and vice versa; i.e., the rail upper section is then laterally stabilized on the top of the post.

The primary anchor means also includes a downwardly projecting ring 26 received into the post upper end, there being a retainer as may include a bolt 27 extending endwise vertically through the ring, as shown. The ring is typically integral with the tines via lateral arms 28 forming a one-pice body. The bolt is adjustable to expand the ring laterally for adjustable frictional retention to interior surfaces of the post, as is clear from FIG. 6. Such surfaces may comprise narrow, vertical bosses 29 protruding interiorly toward the ring, at least two bosses at each side of the ring. Bolt 27 is shown to have a head 30 located between the tines 20, and a retainer nut 31 is located on the threaded end 27*a* of the bolt for rotation to tighten against the ring, adjustably expanding same. The frictional engagement of the ring with the post is located at loci 32, in FIG. 6. If desired, the anchor may first be assembled to the rail upper section 15, and the expanded ring 26 may then be pressed downwardly into the post.

Figure 3:
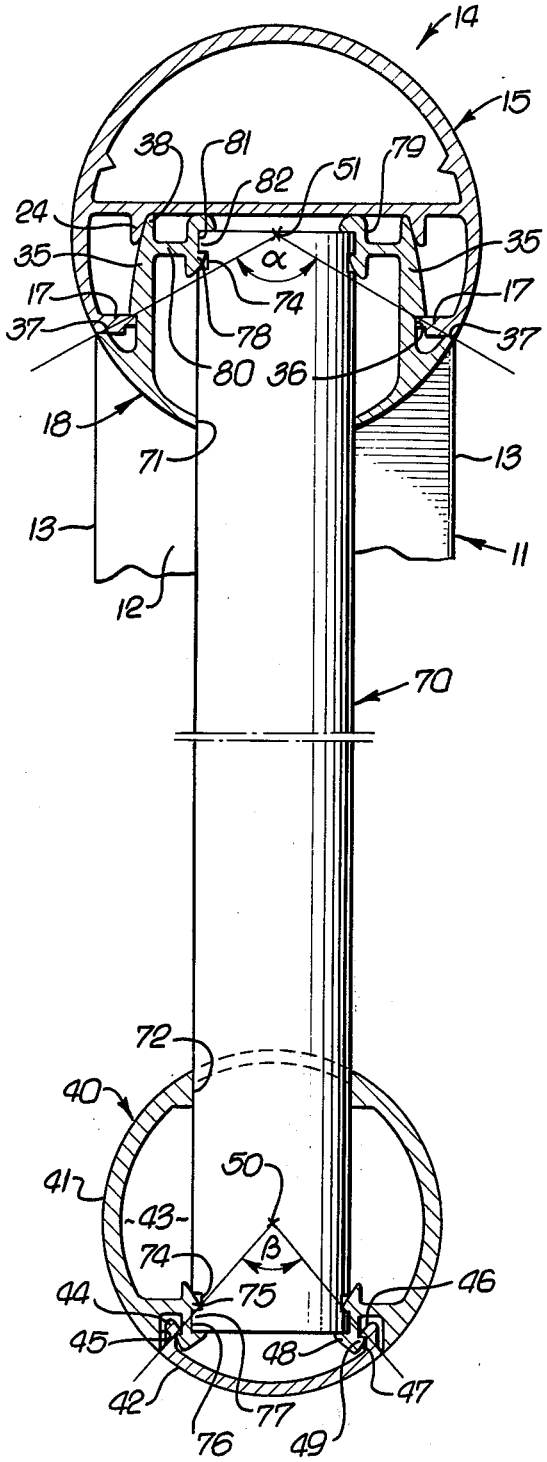
FIG. 3 is an enlarged vertical section taken on lines 3—3 of FIG. 1.

Referring now to FIG. 3, it will be noted that the rail sections 15 and 18 have retention shoulders with detent locking interengagement concealed within the hollow interior defined by the upper rail 14. For example, the section 18 may have a pair of camming tines 35 which project and taper upwardly, for spreading the ledges 17 as the tines are urged upwardly into the upper section 15. Ultimately, the ledges snap into the notches 36 defined by lower extents of the tines, at which time the outermost shoulders 37 on the lower section 18 engage the undersides of the ledges 17 to provide circular continuity of the upper and lower sections 15 and 18. Tongues 24 also center the tine upper terminals 38, and a rigid, locked assembly is formed.

Also provided is a horizontally elongated bottom rail 40 spaced below the top rail 14, and having endwise connection to the side or sides 12 of the posts 11. The bottom rail typically has circular cross section in planes normal to its direction of elongation. The bottom rail includes upper and lower sections 41 and 42 having retention shoulders with detent interlocking engagement concealed within a hollow interior 43 defined by the bottom rail. See for example FIG. 3, showing upstanding tangs 44 integral with section 42 received in grooves 45 formed by the upper section 41, the tangs having downwardly tapering cam shoulders 46 which bear against downwardly tapering cam shoulders 47 on downwardly projecting tangs 48 integral with the upper section 41, upon assembly of the sections. Such tang cam shoulder engagement causes outward yieldable deflection of tangs 44, and inward yieldable deflection of tangs 48, upon assembly, and ultimately the tangs interlock at detent overhang locations 49, as shown.

Note that section 42 subtends an angle $\beta$ about horizontal axis 50, and that the section 41 subtends an angle $(360° - \beta)$ about that axis; and that $\beta$ is substantially less than 180°, but greater than about 45°. Similarly, the section 18 subtends an angle $\alpha$ about horizontal axis 51; that section 15 subtends an angle $(360° - \alpha)$ about that axis; and that $\alpha$ is substantially less than 180° but greater than about 45°. Typically $\alpha$ is greater than $\beta$.

Figure 5:
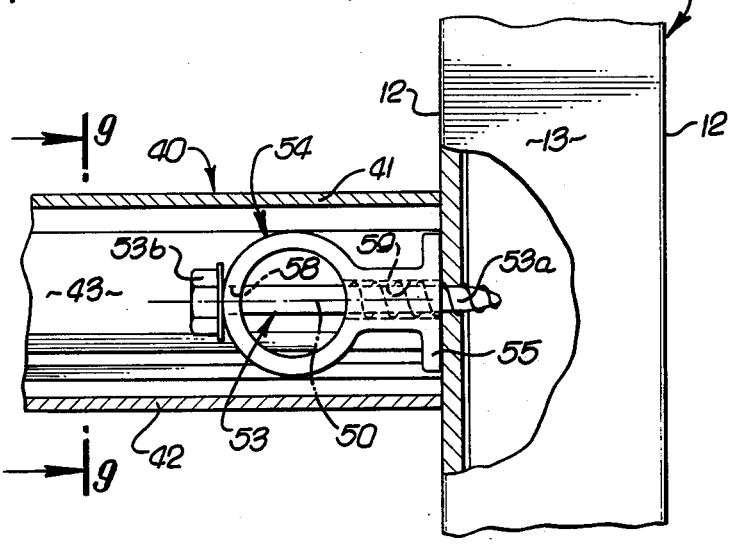
FIG. 5 is a view like FIG. 4 showing a modification.
Figure 9:
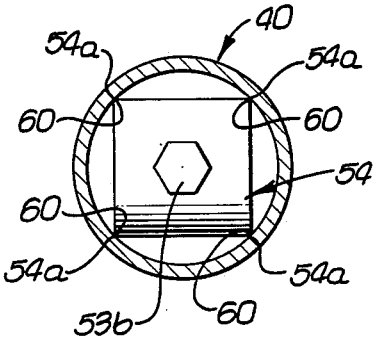
FIG. 9 is an end view on lines 9—9 of FIG. 5.

Secondary anchor means is provided to extend endwise into the tubular lower rail 40 and sidewardly into the post. As shown in FIGS. 5 and 9, such secondary anchor means may, with unusual advantage, include a fastener 53 having threads 53*a* penetrating sidewardly into the post wall 11 to retain the anchor to the post. The fastener, which may comprise a sheet metal screw, also has a head 53*b* located within the interior 43 of the bottom rail, and which is accessible before the lower section 42 is attached to the upper section 41. The anchor may also include a laterally projecting ring 54 integral with a base 55, the latter fitting flatly against the post side wall at location 56, to stabilize the positioning of the anchor and the rail. The base 55 is disc shaped and peripherally fits the bore of the rail, at 57, to provide added stability, blocking shifting of the rail normal to the axis 50 thereof. The fastener 53 extends laterally through the ring and base, i.e, via bores 58 and 59, and is adjustable or tightenable to expand the ring for adjustable frictional retention via ring edges 54*a* to the interior surfaces of the bottom rail, i.e., at locations 60.

Figure 4:
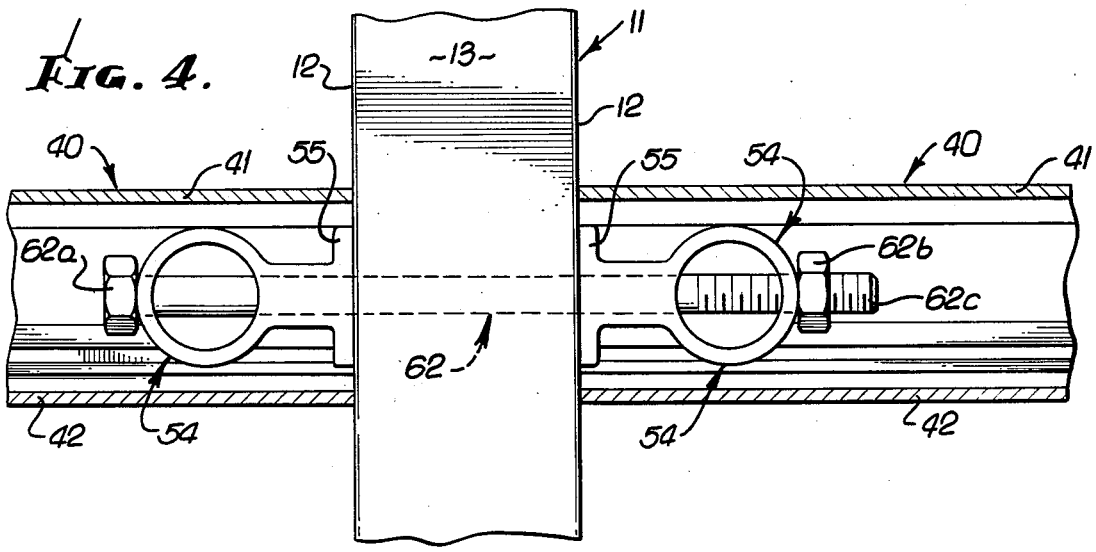
FIG. 4 is an enlarged vertical section taken on lines 4—4 of FIG. 7.

FIG. 4 shows an alternate construction, wherein two tubular bottom rails 40 are provided to extend endwise proximate the opposite side walls 12 of the post. In this version, the anchor means includes two of the ring 54 and base 55 units, the rings projecting axially oppositely as shown. The modified fastener 62, in the form of an elongated bolt, projects or extends laterally through the post, through the two bases 55, and through the two rings 54; also, the fastener is adjustable to clamp and expand the two rings in adjustable frictional engagement with the interior surfaces of the bottom rails. Note bolt head 62*a* bearing against left ring 54, and nut 62*b* on bolt threaded end 62*c*, and engaging the right ring 54.

Finally, as shown in FIGS. 1 and 3, vertical pickets 70 may be provided to extend between and into the upper and lower rails 14 and 40, as via openings 71 and 72 in the sections 18 and 41. The pickets may be circular in horizontal cross section, or rectangular. The pickets and rails have interlocking shoulders located interiorly of the rails to retain the pickets against endwise withdrawal from the rails. For this purpose, the picket may be sidewardly notched at 74 to receive tongues 75 on tangs 48; also the tangs 48 are sidewardly grooved at 76 to receive the lateral projection 77 on the pickets. Similarly, the pickets at their upper ends may be sidewardly notched at 74 to receive tongues 78 on tangs 79 integral with tines 35. Webs 80 connect the tangs 79 to the tines. Also, the tangs 79 are sidewardly grooved at 81 to receive the lateral projection 82 on the pickets. Snap-together detent connections of the pickets to the rails are thereby provided, and it will be seen that the entire rail assembly may be assembled in a very easy, rapid and low cost manner.

Figure 7:
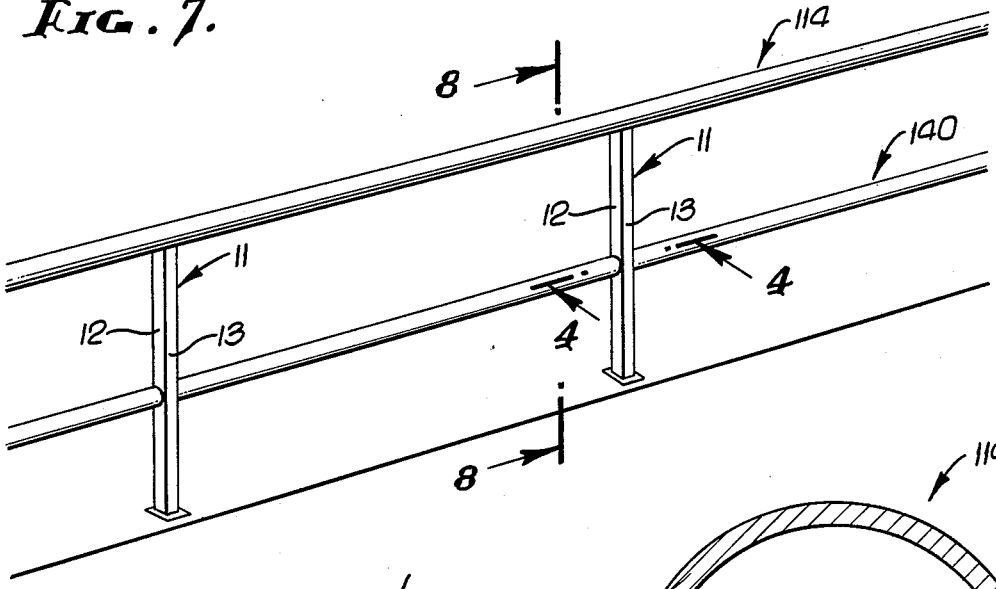
FIG. 7 is a view like FIG. 1 but showing a modified construction.
Figure 8:
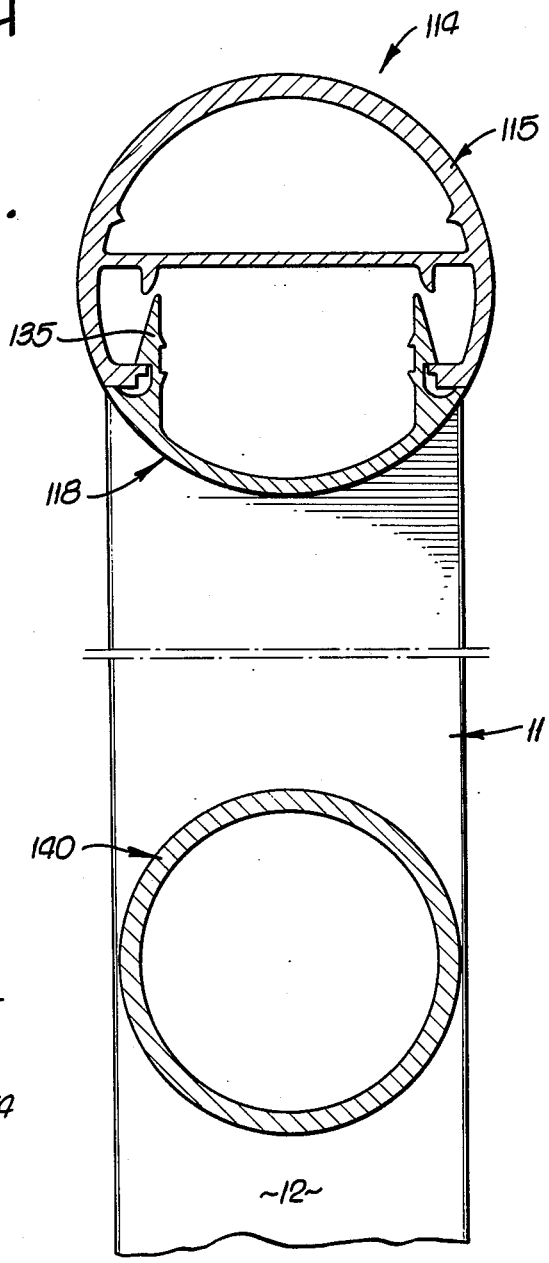
FIG. 8 is an enlarged vertical section taken on lines 8—8 of FIG. 7.
Figure 6:
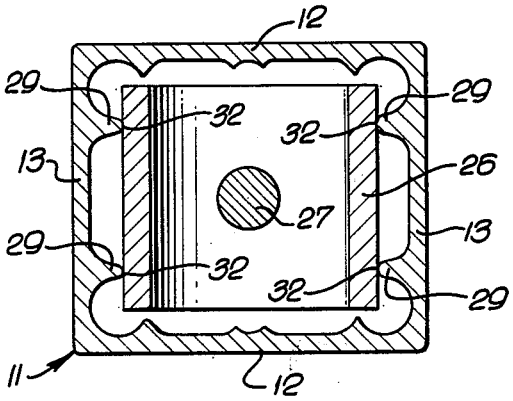
FIG. 6 is a horizontal section taken on lines 6—6 of FIG. 2.

The modified railing shown in FIGS. 7 and 8 includes upper and lower rails 114 and 140, and posts 11 as before. The upper rail 114 includes an upper section 115 like section 15; and lower section 118 is like lower section 18 except for elimination of structure 78, 80 and 81 on the tines 135. The lower rail 140 is unitary and tubular, and may be attached to the posts as seen in FIGS. 4 and 8. The lower rail is press fit over fittings, and rotation of the lower rails tightens the bolt and expands the circular portions of the fittings, which draws the lower rails to the post and assures a tight joint between the post and lower rails. In this regard, all fittings at the top and lower rails may alternatively be pre-expanded by tightening the bolt or screw, and the fittings may then be forcibly driven into the post or power rails. Accordingly, pickets need not be employed or used.

All of the railing elements may advantageously consist of lightweight metal such as aluminum, or thin-walled steel.

I claim:

1. In a railing assembly, the combination comprising:
   a. an upright post having generally rectangular cross section in horizontal planes,
   b. an elongated upper rail including an upper section having an upwardly convex generally semicircular cross section in a plane normal to the direction of elongation, said upper section opening downwardly and extending directly over the open top of said post, the post supporting the upper section,
   c. primary anchor means extending upwardly into the rail upper section and downwardly into the top of the post to anchor the rail to the post, and
   d. an elongated bottom closure section attached to the rail upper section to close said downward opening, said closure section extending endwise proximate the side of the post,
   e. said primary anchor means including a pair of upward projecting camming tines which are laterally spaced apart, each tine defining an upper terminal and a lower step shoulder, and said upper rail upper section defining laterally projecting ledges having detent locking engagement with said step shoulders, said primary anchor means including a downwardly projecting ring received into the post, there being a retainer extending vertically through the ring, the retainer being adjustable to clamp and expand the ring laterally for adjustable frictional retention to interior surfaces on the post, said tines and ring being integral.

2. The combination of claim 1 wherein the closure section is generally semi-circular in cross section in a plane normal to the direction of elongation, thereby to form a circular continuation of the rail upper section.

3. The combination of claim 1 wherein the rail sections have retention shoulders with detent locking interengagement concealed within a hollow interior defined by the upper rail.

4. The combination of claim 1 including an elongated bottom rail extending endwise proximate one side of the post, the bottom rail being generally circular in cross sections normal to its direction of elongation.

5. The combination of claim 4 including vertical pickets extending between and into said upper and bottom rails, the pickets and rails having interlocking shoulders interiorly of the rails to retain the pickets against endwise withdrawal from the rails.

6. The combination of claim 4 wherein the bottom rail includes upper and lower sections having retention shoulders with detent locking interengagement concealed within a hollow interior defined by the bottom rail.

7. The combination of claim 6 including secondary anchor means extending endwise into the bottom rail and sidewardly into the post.

8. The combination of claim 7 wherein said secondary anchor means includes a threaded fastener extending sidewardly into the post, the fastener having a head which is accessible when the bottom rail lower section is detached from the bottom rail upper section.

9. The combination of claim 1 wherein said upper rail upper section also defines downwardly projecting tongues having camming interengagement with said upper terminals to center the tines relative to the upper rail upper section.

10. In a railing assembly, the combination comprising:
   a. an upright post having rectangular cross section in horizontal planes,
   b. an elongated upper rail including an upper section having an upwardly convex generally semicircular cross section in a plane normal to the direction of elongation, said upper section opening downwardly and extending directly over the open top of said post, the post supporting the upper section,
   c. primary anchor means extending upwardly into the rail upper section and downwardly into the top of the post to anchor the rail to the post, and
   d. an elongated bottom closure section attached to the rail upper section to close said downward opening, said closure section extending endwise proximate the side of thhe post,
   e. said primary anchor means including a pair of upward projecting camming tines which are laterally spaced apart, each tine defining an upper terminal and a lower step shoulder, and said upper rail upper section defining laterally projecting ledge having detent locking engagement with said step shoulders, said primary anchor means including a downwardly projecting ring received into the post, there being a retainer extending vertically through the ring, the retainer being adjustable to clamp and expand the ring laterally for adjustable frictional retention to interior surfaces on the post,
   f. said surfaces comprising narrow, vertical bosses protruding toward said ring.

11. In a railing assembly, the combination comprising:
   a. an upright post having rectangular cross section in horizontal planes,
   b. an elongated upper rail including an upper section having an upwardly convex generally semicircular cross section in a plane normal to the direction of elongation, said upper section opening downwardly and extending directly over the open top of said post, the post supporting the upper section,
   c. primary anchor means extending upwardly into the rail upper section and downwardly into the top of the post to anchor the rail to the post, and
   d. an elongated bottom closure section attached to the rail upper section to close said downward opening, said closure section extending endwise proximate the side of the post,
   e. there being an elongated bottom rail extending endwise proximate one side of the post, the bottom rail being generally circular in cross sections normal to its direction of elongation, f. there being secondary anchor means extending endwise into the bottom rail and sidewardly into the post, said secondary anchor means including a threaded fastener extending sidewardly into the post, the fastener having a head which is accessible when a bottom rail lower section is detached from a bottom rail upper section, g. said secondary anchor means including a laterally projecting ring received into the bottom rail interior, said fastener extending laterally through the ring, the fastener being adjustable to clamp and expand the ring for adjustable frictional retention to the interior surfaces of the bottom rail, the anchor means also including a base integral with the ring and flatly fitting against the post side wall, the base also peripherally fitting a bore defined by the bottom rail.

12. In a railing assembly, the combination comprising:

a. an upright post having rectangular cross section in horizontal planes, b. an elongated upper rail including an upper section having an upwardly convex generally semicircular cross section in a plane normal to the direction of elongation, said upper section opening downwardly and extending directly over the open top of said post, the post supporting the upper section, c. primary anchor means extending upwardly into the rail upper section and downwardly into the top of the post to anchor the rail to the post, and d. an elongated bottom closure section attached to the rail upper section to close said downward opening, said closure section extending endwise proximate the side of the post, e. there being an elongated bottom rail extending endwise proximate one side of the post, the bottom rail being generally circular in cross sections normal to its direction of elongation.

f. there being secondary anchor means extending endwise into the bottom rail and sidewardly into the post, said secondary anchor means including a threaded fastener extending sidewardly into the post, the fastener having a head which is accessible when a bottom rail lower section is detached from a bottom rail upper section, g. and including a second bottom rail like the first mentioned bottom rail and extending endwise proximate the opposite side of the post, said secondary anchor means including laterally oppositely projecting rings received into the interiors of the bottom rails near the post, said fastener extending laterally through the post and through said rings, the fastener being adjustable to clamp and expand the two rings for adjustable frictional retention to interior surfaces of the bottom rails.

* * * * *